United States Patent [19]

Kaufmann

[11] Patent Number: 4,858,640

[45] Date of Patent: Aug. 22, 1989

[54] PROCESS FOR FEEDING GAS STORED IN A CAVERN STORAGE FACILITY INTO A CONSUMER NETWORK, AND A LAYOUT FOR IMPLEMENTING SUCH A PROCESS

[76] Inventor: Klaus-Dieter Kaufmann, Morassistrasse 21, 8000 Munich 5, Fed. Rep. of Germany

[21] Appl. No.: 114,849

[22] Filed: Oct. 30, 1987

[30] Foreign Application Priority Data

Nov. 3, 1986 [DE] Fed. Rep. of Germany ..... 3637370

[51] Int. Cl.[4] ..... F17D 1/04

[52] U.S. Cl. ..... 137/236.1; 137/256; 137/266

[58] Field of Search ..... 137/236.1, 255, 256, 137/266; 48/190

[56] References Cited

U.S. PATENT DOCUMENTS

| | | | |
|---|---|---|---|
| 2,550,844 | 5/1951 | Meiller et al. | 137/266 X |
| 2,948,294 | 8/1960 | Smith | 137/266 X |
| 3,016,956 | 1/1962 | Olandt | 137/266 X |
| 3,950,958 | 4/1976 | Loofbourow | 48/190 X |

FOREIGN PATENT DOCUMENTS

| | | | |
|---|---|---|---|
| 2334801 | 1/1975 | Fed. Rep. of Germany | 48/190 |

*Primary Examiner*—John Rivell

*Attorney, Agent, or Firm*—John J. Byrne

[57] ABSTRACT

The subject of the invention is represented by a process and a layout for feeding gas stored in a cavern storage facility into a consumer network, in which a high feed-out rate for removal of gas over a protracted period of time can be achieved by means of a multistage procedure by prescribing specific supply line paths between the individual storage caverns and the consumer network to be supplied and by coordinating removal of gas from the individual storage caverns at an originally high storage pressure to a minimum residual pressure which is still below the operating pressure in the consumer network, by means of suitably controlled shut-off valves in the connecting supply line system between storage caverns and consumer network, the only ancillar equipment provided being a compressor station also required for feeding gas into the storage caverns. The gas fed out may also be subjected during its passage through the connecting supply line system to heating by delivery of external heat and to drying to remove the residual moisture content.

11 Claims, 2 Drawing Sheets

Figure 1A:
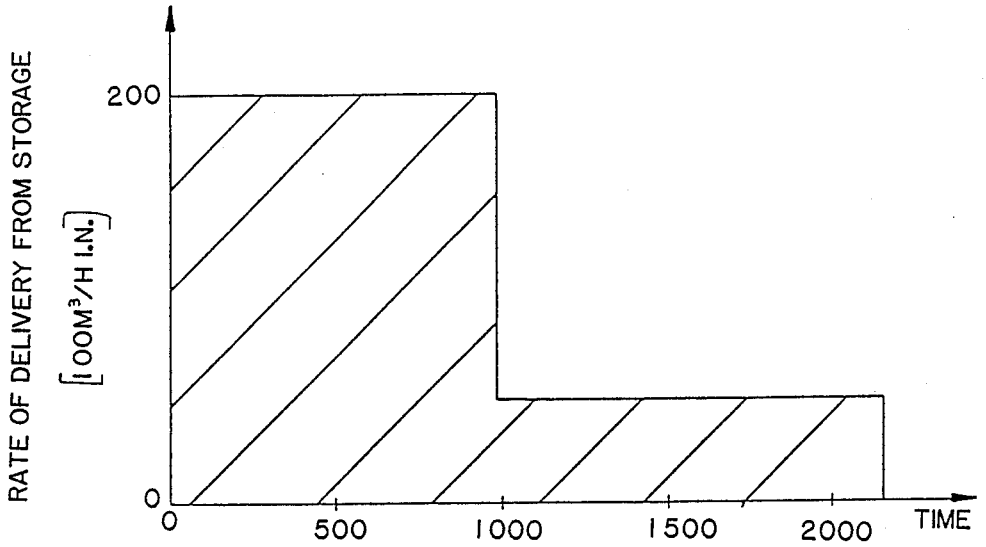

PROCESS FOR FEEDING GAS STORED IN A CAVERN STORAGE FACILITY INTO A CONSUMER NETWORK, AND A LAYOUT FOR IMPLEMENTING SUCH A PROCESS

The invention relates in general to operation of cavern storage facilities for temporary storage of gas, and relates in particular to a process for feeding gas stored in a cavern storage facility with at least two individual caverns under high storage pressure into a consumer network operating at lower pressure by using an interposable compressor station, and to a layout for implementing such a process.

In the context of supplying consumers with natural gas in particular, temporary storage of large quantities of gas, even over a protracted period, in cavern storage facilities has been introduced as a precaution against disruption or interruption of supply of gas from sources often situated at very great distances; such facilities include a plurality of individual caverns which are excavated, for example, in salt domes and which can be connected to the pertinent consumer network by means of an appropriate supply line system. During periods of supply of excess gas from primary sources, these storage caverns are filled with natural gas from the consumer network, the stored gas being placed under a storage pressure exceeding the operating pressure in the consumer network by means of a compressor station incorporated in the connecting supply line system. If necessary, the gas stored in this manner is again removed from the caverns and fed into the consumer network, the pressure being suitably reduced.

To insure delivery to consumers commensurate with demand under this supply system involving temporary gas storage, it must be possible to feed large amounts of gas per unit time into the consumer network from the storage caverns over the longest possible period of time. Hence removal from storage must take place at the highest possible flow rate, and this high flow rate must be maintained over the longest possible periods.

Attainment of this goal is hindered, however, by the circumstances that, when gas is removed from the storage caverns at a high rate, the removal process is to be regarded as already ended because the delivery pressure vanishes if the pressure level in the storage caverns has dropped to the value of the pressure level in the consumer network, even if the storage caverns still contain considerable amounts of gas at this time. It is true that in theory this gas could be utilized by means of incorporated feed-out compressors, but in this case such large compressor capacities would be required in order to maintain satisfactorily high feed-out rates that economically unjustifiable expense would be required, from the viewpoint both of the investments required and of the routine operating costs.

Hence the invention is based on the task of arriving at a way of maintaining the feed-out rate at a high value as previously over a lengthy period, at economically acceptable cost, in removal of stored gas from a cavern storage facility to be fed into a consumer network, and simultaneously of providing for feed-out of the largest possible amount of gas.

It is claimed for the invention that the assigned task is accomplished on the basis of a process of the kind mentioned at the outset by means of multiple-stage operation in the first stage of which gas is removed solely from a first individual cavern, the storage pressure dropping to the operating pressure, and is discharged into the consumer network for delivery, while in subsequent stages the cavern from which gas has been discharged is connected to the suction side of the compressor station and the next following individual cavern, still under high storage pressure, is connected to the consumer network from the pressure side of the compressor station, and in a last stage the last individual cavern from which gas is removed is completely emptied into the consumer network by way of the compressor station.

A preferred layout for implementation of the process claimed for the invention has a supply line system with a compressor station, which system connects the various individual caverns to the consumer network, and is characterized by the fact that the connecting supply line system has a first common main and a second common main each of which is connected to each individual cavern by way of a tie line of its own containing a shut-off valve and a control valve and to which over a first supply line path at least the first common main may be connected directly, and over a second supply line path at least the second common main may be connected through incorporation of the compressor station, to an outlet or inlet line leading to or coming from the consumer network.

Advantageous embodiments and developments of the invention as regards both the process claimed for the invention and the configuration for its implementation are set forth in the individual subsidiary claims.

By means of the invention it is possible significantly to prolong the period during which gas stored in a cavern storage facility can be fed at a high feedout rate into a connected consumer network, without the need for cost-ineffective installation and operating expenses. In essence, it is necessary rather to provide only the additional assemblies also required for feeding gas into the storage caverns, while for the purposes of the invention all that are required in principle are installation and suitable control of shut-off valves in the individual lines of the connecting supply line system between the storage caverns and the consumer network for the creation of specific supply line paths.

In one preferred embodiment, the invention yields a process and a layout for feeding into a consumer network gas stored in a cavern storage facility, in which process a high feed-out rate can be achieved over a prolonged period for removal of gas, by means of a multiple-stage procedure with specific supply line paths specified between the individual storage caverns and the consumer network to be supplied and by coordinating removal from the individual caverns at an initially high storage pressure to a minimum residual pressure which is still below the operating pressure in the consumer network, by means of suitably controlled shut-off valves, the only ancillary equipment provided being a compressor station, which is also required for feeding gas into the storage caverns. In addition, the gas fed out may be subjected to heating by delivery of heat from an external source and to drying to remove the residual moisture content during its passage through the connecting supply line system.

Figure 1B:
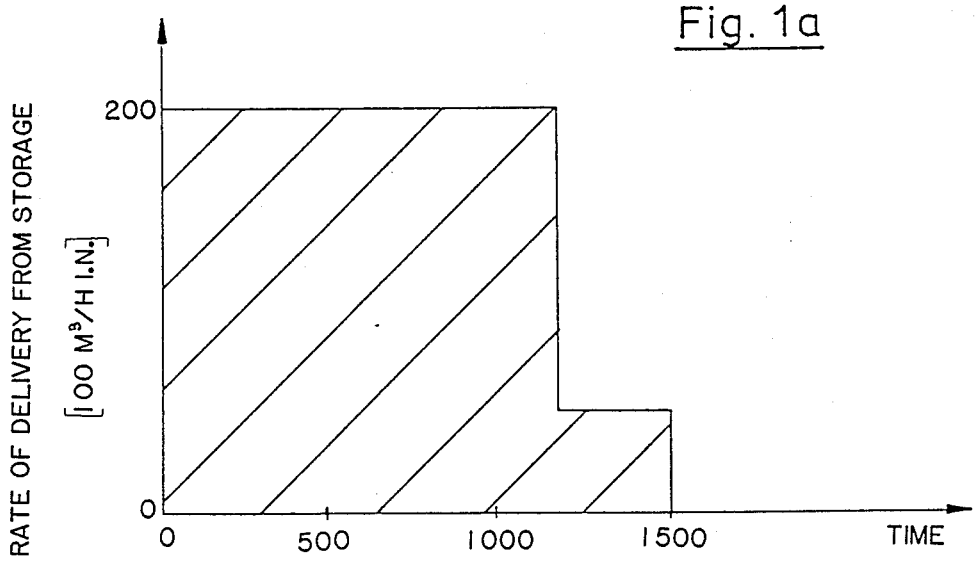
Figure 2:
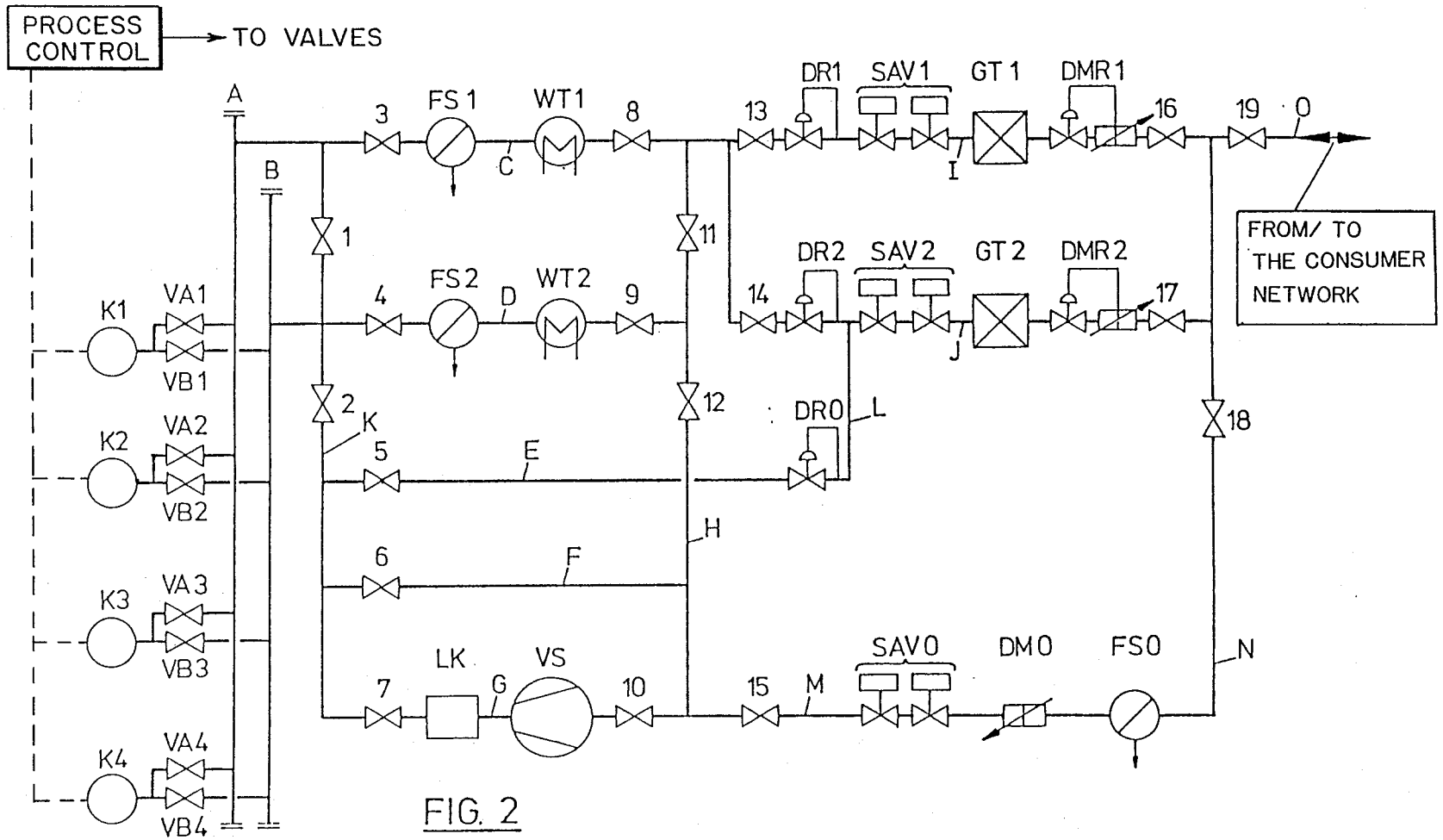

Reference is now made for additional explanation of the invention, its characteristics, and its advantages to the drawing, in which the structure and mode of operation of a preferred embodiment are shown diagrammatically; in particular in the drawing:

FIG. 1*a* shows the behavior of the feed-out rate over time in removal from a cavern storage facility in the thus far customary manner;

FIG. 1*b* shows a corresponding time dependency diagram for feed-out of gas from a similar cavern storage facility by the process claimed for the invention; and FIG. 2 shows the structure of a layout claimed for the invention in a block diagram relating to a cavern storage facility with four individual caverns.

The illustration in FIG. 2 shows a general diagram of a layout as claimed for the invention, which layout connects a cavern storage facility having four individual caverns K1, K2, K3, and K4 for storage of natural gas, for example, to a consumer network not shown.

The layout shown contains a first common main A and a second common main B each of which is connected to each of the caverns K1 to K4 by way of a tie line of its own. In each of these tie lines there are shut-off valves VA1, VA2, VA3, and VA4 and VB1, VB2, VB3, and VB4 respectively which clear or block the flow path for passage of gas between the first common main A and the individual caverns K1 to K4 or the flow path between the second common main B and the individual caverns K1 to K4, depending on the setting of these valves.

From the common main A there also leads a first supply line path from a line C and a connecting line I to an inlet or outlet line O, which in turn effects connection with the consumer network not shown in the drawing. Along the path of the line C, as viewed from common main A, there are to be seen in sequence a shut-off valve 3, a filter separator FS1, a heat exchanger WT1, and a shut-off valve 8, while the line I as viewed in the same direction contains in sequence a shut-off valve 13, a pressure reduction station DR1, safety shut-off devices SAV1, a gas dryer GT1, flow control and regulation devices DMR 1, and a shut-off valve 16. At the beginning of the outlet or inlet line O there is mounted a shut-off valve 19 by means of which the flow path to and from the consumer network can be blocked or cleared.

From the second common main B there branches off a line D which forms a first section of a second supply line path to the outlet or inlet line O and beyond the common main B contains in sequence a shut-off valve 4, a filter separator FS2, a heat exchanger WT2, and a shut-off valve 9. There also belong to the second supply line path, in sequence, a section of a line H which branches off between the lines C and I and their shut-off valves 8 and 13 and leads to line D and beyond, which line H contains a shut-off valve 11 between lines C and D, and beyond the point of its connection with line D a shut-off valve 12; and a line G connected to line H, which line G, beyond the point of its connection with line H, contains in sequence a shut-off valve, a compressor station VS, an air cooler LK for cooling the gas leaving the compressor station VS, and a shut-off valve 7. There is connected to line G a line K which leads to the point of connection of the line D with the common main B and subsequently to the line C, on the side of the latter connected to the common main B, and which line K between lines C and D contains a shut-off valve 1 and, before the point of its connection with the line D, a shut-off valve 2. Upstream from the shut-off valve 2 there branches from the line K a line E which contains in sequence a shut-off valve 5 and a pressure reduction station DR0. The line E is connected by way of connecting line L to a line J, which branches off at the point of connection between lines C and I of the first supply line path and, like the line I, contains in sequence a shut-off valve 14, a pressure reduction station DR2, safety shut-off devices SAV2, a gas dryer GT2, flow measurement and control devices DMR2, and a shut-off valve 17. The line L, which forms an additional section of the second supply line path and to this extent represents an extension of the line E, ends in the line J between the pressure reduction station DR2 and the safety shut-off devices SAV2, with which the line J to its end forms an additional section of the second supply line path. The termination of the second supply line path is formed by a line N which branches off between the shut-off valves 16 and 19 at the point of connection between the line I and outlet or inlet line O and beyond its connection with the line J contains a shut-off valve 18. Hence the second supply line path consists in the aggregate of the line D with the subsequent section of the line H with shutoff valve 12, the line G, the subsequent section of the line K to the point of its connection with the line E, the line E itself, the line L, the subsequent section of the line J from the pressure reduction station DR2 to the point of connection of the line J with the line N and the subsequent section of the line N to the point of connection of the line N with the lines I and O between the shut-off valves 16 and 19.

An internal connection within the second supply line path is formed by a line F, which branches from the line K between the point of connection with the line G and the shut-off valve 2 and which leads to line H, where it ends between the point of connection of the latter with the line G and shut-off valve 12. As a result of this situation, the line F, which contains a shut-off valve 6, provides the possibility of bypassing the structural stages incorporated in the line G, such as in particular the compressor station VS, whose suction side faces the line H and whose pressure side faces the line K. In this way, gas can be fed in or rerouted and can bypass the compressor station.

To the connecting supply line system shown in FIG. 2 there is added a line M, which is connected to the line N beyond shut-off valve 18 and which leads to the point of connection of the line H with the line G. Along the path of the line M there are, beyond the line N, in sequence, a filter separator FS0, a flow measurement and control device DM0, safety shut-off devices SAV0, and a shut-off valve 15. The line M is used to feed gas in from the consumer network or to transfer gas between the storage caverns.

The connecting supply line system designated in FIG. 2 by lines A to O, as is shown by the foregoing description of the routing of the lines, allows feeding of gas delivered by way of the consumer network into the various caverns K1 to K4, transfer of gas between the caverns K1 to K4, and feeding of gas from the caverns K1 to K4 into the consumer network, it being possible to effect such feed-out in a novel and particularly advantageous manner. The entire operation of the cavern storage facility, in conjunction with the storage processes indicated in the foregoing, is accomplished preferably by controlling in particular the opening and closing of various valves 1 to 19 and VA1 to VB4 by means of a process control unit shown in FIG. 7 which control unit creates by selective opening and closing of the individual valves the supply line paths required in each particular instance over which gas can flow. A particular advantage in this situation is that different values of physical parameters such as the temperature or the moisture content of the gas in the individual caverns can be taken into account, and accordingly the total process involved can be optimized. It may also be noted in this context that each of the storage caverns K1 to K4 described can in turn be subdivided into several component caverns, and so it is possible to provide a group of caverns which can be operated on a uniform basis, rather than as an individual cavern.

One possible operating example will be described in what follows to illustrate the mode of operation of the cavern storage facility shown in FIG. 2. The following base data are adopted as points of reference in the following discussion:

Geometric volume of the four caverns or cavern groups K1 to K4: 400,000 cubic meters each;

Initial storage pressure of stored gas (dry natural gas): 180 bar;

Initial temperature of stored gas and surrounding rock: 50° C.;

Desirable total feed-out rate (over longest possible period of time): 200,000 cubic meters per hour (i. N. [industrial standard]);

Pressure level in consumer network: 50 bar;

Capacity of compressor station VS sufficient for delivery of 50,000 cubic meters per hour (i. N.) under a pressure of 50 bar in delivery at pressures between 20 and 50 bar;

Minimum pressure level in caverns K1 to K4: approximately 20 bar.

On the basis of these reference data, feed-out of gases from caverns K1 to K4 by the process claimed for the invention is effected in a total of five consecutive stages, as indicated below:

1. Removal of gas from cavern K1 only at the prescribed feed-out rate of 200,000 $m^3/h$ (i. N.) until a gas pressure of 50 bar is reached in cavern K1 over the first supply line path;
2. Shifting of cavern K1 to the second supply line path and connection of cavern K2 to the first supply line path, the total feed-out rate of 200,000 $m^3/h$ (i. N.) being maintained, with a feed-out rate of 150,000 $m^3/h$ (i. N.) for cavern K2 and simultaneous additional removal of gas from cavern K1 at a feed-out rate of 50,000 $m^3/h$ (i. N.); the compressor station VS operates until a gas pressure of 50 bar is reached in cavern K2 and a gas pressure of around 20 bar in cavern K1;
3. Disconnection of cavern K1, shifting of cavern K2 to the second supply line path, and connection of cavern K3 to the first supply line path for removal of gas at a total feed-out rate of 200,000 $m^3/h$ (i. N.) from caverns K2 (feed-out rate of 50,000 $m^3/h$ (i. N.) by way of the compressor station VS) and K3 (feed-out rate of 150,000 $m^3/h$ (i. N.)) until a gas pressure of 50 bar is reached in cavern K3 and a gas pressure of approximately 20 bar in cavern K2;
4. Disconnection of cavern K2, shifting of cavern K3 to the second supply line path and connection of cavern K4 to the first supply line path for removal of gas at a total feed-out rate of 200,000 $m^3/h$ (i. N.) from caverns K3 and K4 until a gas pressure of 50 bar is reached in cavern K4 and approximately 20 bar in cavern K3;
5. Disconnection of cavern K3 and shifting of cavern K4 to the second supply line path for the purpose of ultimate discharge of the latter at a gas pressure of approximately 20 bar by way of the compressor station VS.

The settings (open or closed) of the various valves 1 to 19 and VA1 to VB4 required for the stages 1 to 5 specified in the foregoing are given below in tabular form. For the sake of complete description of the operating process in the cavern storage facility shown in FIG. 2, the table also shows the corresponding relationships for introduction of gas into caverns K1 and K4 and for examples of internal transfer of gas between caverns K1 to K4.

The following individual phases of operation are included in the table:

BE: Introduction of gas into storage

BA1: Gas feed-out (first stage)

BA2: Gas feed-out (second stage)

BA3: Gas feed-out (third stage)

BA4: Gas feed-out (fourth stage)

BA5: Gas feed-out (fifth stage)

BUDH: Direct gas transfer from one cavern (here cavern K1) at higher pressure into a cavern (here cavern K2) at lower pressure by way of a filter separator (here FS1) and heat exchanger (here WT1)

BUDN: Direct gas transfer from one cavern (here cavern K3) at lower pressure into a cavern (here cavern K4) at higher pressure by way of a filter separator (here FS1) and heat exchanger (here WT1) and compressor station (VS)

BUTH: Direct gas transfer from one cavern (here cavern K1) at higher pressure into a cavern (here cavern K2) at lower pressure by way of filter separators (here FS0 and FS1), heat exchanger (here WT1), and gas dryer (here GT1), the compressor station being bypassed by way of line F (for a gas pressure in cavern K2 below the permissible pressure level in cavern K2)

BUDN: Direct gas transfer from one cavern (here cavern K3) at lower pressure into a cavern (here cavern K4) at higher pressure by way of filter separators (here FS0 and FS1), heat exchanger (here WT1), and gas dryer (here GT1), the compressor station VS being switched on.

The position of valves 1 to 19 and VA1 to VB4 is indicated in the table by the symbols "1" (open) and "0" (closed).

| | Phase of Operation | | | | | | | | | |
|---|---|---|---|---|---|---|---|---|---|---|
| Valve | BE | BA1 | BA2 | BA3 | BA4 | BA5 | BUDH | BUDN | BUTH | BUTN |
| 1 | 0 | 1 | 0 | 0 | 0 | 0 | 0 | 0 | 0 | 0 |
| 2 | 1 | 0 | 0 | 0 | 0 | 0 | 1 | 1 | 1 | 1 |
| 3 | 0 | 1 | 1 | 1 | 1 | 0 | 1 | 1 | 1 | 1 |
| 4 | 0 | 1 | 1 | 1 | 1 | 1 | 0 | 0 | 0 | 0 |
| 5 | 0 | 0 | 1 | 1 | 1 | 1 | 0 | 0 | 0 | 0 |
| 6 | 0 | 0 | 0 | 0 | 0 | 0 | 1 | 0 | 1 | 0 |
| 7 | 1 | 0 | 1 | 1 | 1 | 1 | 0 | 1 | 0 | 1 |
| 8 | 0 | 1 | 1 | 1 | 1 | 0 | 1 | 1 | 1 | 1 |

-continued

| Valve | Phase of Operation | | | | | | | | | |
|---|---|---|---|---|---|---|---|---|---|---|
| | BE | BA1 | BA2 | BA3 | BA4 | BA5 | BUDH | BUDN | BUTH | BUTN |
| 9 | 0 | 1 | 1 | 1 | 1 | 1 | 0 | 0 | 0 | 0 |
| 10 | 1 | 0 | 1 | 1 | 1 | 1 | 0 | 1 | 0 | 1 |
| 11 | 0 | 1 | 0 | 0 | 0 | 0 | 1 | 1 | 0 | 0 |
| 12 | 0 | 0 | 1 | 1 | 1 | 1 | 1 | 1 | 0 | 0 |
| 13 | 0 | 1 | 1 | 1 | 1 | 0 | 0 | 0 | 1 | 1 |
| 14 | 0 | 1 | 1 | 1 | 1 | 0 | 0 | 0 | 0 | 0 |
| 15 | 1 | 0 | 0 | 0 | 0 | 0 | 0 | 0 | 1 | 1 |
| 16 | 0 | 1 | 1 | 1 | 1 | 0 | 0 | 0 | 1 | 1 |
| 17 | 0 | 1 | 1 | 1 | 1 | 1 | 0 | 0 | 0 | 0 |
| 18 | 1 | 0 | 0 | 0 | 0 | 0 | 0 | 0 | 1 | 1 |
| 19 | 1 | 1 | 1 | 1 | 1 | 1 | 0 | 0 | 0 | 0 |
| VA1 | 0 | 1 | 0 | 0 | 0 | 0 | 1 | 0 | 1 | 0 |
| VA2 | 0 | 0 | 1 | 0 | 0 | 0 | 0 | 0 | 0 | 0 |
| VA3 | 0 | 0 | 0 | 1 | 0 | 0 | 0 | 1 | 0 | 1 |
| VA4 | 0 | 0 | 0 | 0 | 1 | 0 | 0 | 0 | 0 | 0 |
| VB1 | 1 | 0 | 1 | 0 | 0 | 0 | 0 | 0 | 0 | 0 |
| VB2 | 1 | 0 | 0 | 1 | 0 | 0 | 1 | 0 | 1 | 0 |
| VB3 | 1 | 0 | 0 | 0 | 1 | 0 | 0 | 0 | 0 | 0 |
| VB4 | 1 | 0 | 0 | 0 | 0 | 1 | 0 | 1 | 0 | 1 |

As is shown by the foregoing table and the explanation of the operating process preceding it, in the embodiment of the invention in question the common main A operates predominantly at higher operating pressure, for example 50 to 180 bar, while the operating pressure in the common main B is for the most part lower, for example at a value between 20 and 50 bar. Common main A is accordingly used primarily for feed-out of gas from storage caverns still under high pressure, by way of valves VA1 to VA4, while a path leading over common main B and valves VB1 to VB4 is provided for delivery of gas to and feed-out of gas from storage caverns that have already been largely emptied.

Beyond the collective main A the gas to be fed out flows along the first supply line path, while gas feed is continued essentially along the second supply line path from the common main B. Along both supply line paths the pressure reduction stations, DR0 in line E, DR2 in line J, and DR1 in line I, delimit a range adapted to the high storage pressure which may prevail in storage caverns K1 to K4 from a second range designed for the lower operating pressure in the consumer network. An operative connection between the two supply line paths is provided only between ranges designed for the same operating pressure; line L connects lines E and J beyond the low-pressure side of the pertinent pressure reduction station, DR0 or DR2.

FIGS. 1*a* and 1*b* illustrate the prolongation of the gas feed-out period that can be achieved by means of the invention, on the basis of two time-dependency diagrams, the first of which (FIG. 1*a*) shows the relationships in thus far customary simultaneous unloading of all extant storage caverns, first from the initial pressure level to the operating pressure in the consumer network and then, with a feed-out compressor station engaged, down to residual pressure, while the second diagram (FIG. 1*b*) reflects the pattern of the feedout rate over time in removal of gas from a similar cavern storage facility by the process claimed for the invention.

Comparison of the two diagrams shows that the period during which the feed-out rate can be kept at a high value desirable for supply of the consumer network is distinctly longer, by about 20%, under the conditions of the invention than is the case with the state of the art solution. The total amount of gas that can be removed, indicated by the shaded areas in the diagrams, is approximately the same in both cases.

I claim:

1. A process for feeding gas stored under high pressure in a multiple cavern storage facility into a consumer network operating at a lower pressure by use if an interposable compressor station comprising:

a first stage wherein gas is removed exclusively from a first individual cavern and fed directly into the consumer network to be supplied;

at least one subsequent stage occurring when the gas in said first individual cavern reaches a pressure of approximately that of the consumer network wherein said subsequent stage includes connecting said first individual cavern to the suction side of said compressor station, and further connecting a second individual cavern to the consumer network together with the pressure side of said compressor station to provide gas to said consumer network from both said first and second caverns simultaneously;

said first and subsequent stages are repeated until each of said caverns have been fully evacuated into the consumer network.

2. A process is claimed in claim 1, wherein the gas to be fed out is heated externally by delivery of heat along its path from the storage caverns to the consumer network.

3. A process as claimed in claim 1, wherein the gas to be fed out is dried along its path from the storage caverns to the consumer network.

4. Apparatus for feeding gas stored under high pressure in a multiple cavern storage facility into a consumer network operating at a lower pressure comprising:

a first common main;

a second common main;

a plurality of gas containing caverns;

a first set of valves through which each of the said first and second mains are connected to each of said plurality of gas containing caverns;

a compressor station whose output is selectively to said consumer network;

second set of valves interposed between said first and second mains and said compressor station for selectively connecting said first and second mains to the input side of said compressor station;

process control means for selectively operating said first and second sets of valves to introduce gas from one of said plurality of caverns into said consumer network directly through one of said first or second mains;

said process control means is further operative to selectively actuate said first and second sets of valves to introduce gas from another of said plurality of caverns into said consumer network through said compressor station;

wherein high pressure gas from one of said caverns be introduced directly into the consumer network while lower pressure gas may be extracted from one of said individual caverns through said compressor station and simultaneously introduced into said consumer network.

5. The apparatus claimed in claim 4 wherein at least one of said two common mains may be connected to first and second supply line paths.

6. The apparatus claimed in claim 4 wherein said both common mains may be connected to first and second supply line paths.

7. The apparatus claimed in claim 5 wherein a heat exchanger is inserted into both of said first and second supply line paths to heat the gas flowing therethrough.

8. The apparatus claimed in claim 5 wherein a gas dryer is inserted into both first and second supply line paths to dry the gas flowing through.

9. The apparatus claimed in claim 5 wherein both first and second supply line paths are subdivided by pressure reduction stations into first and second regions designed for high storage pressure and low storage pressure respectively.

10. The apparatus claimed in claim 4 wherein said compressor station is bypassed by a parallel line which includes a shut-off valve.

11. The apparatus claimed in claim 4 wherein said process control means operates responsive to physical parameters such as gas pressure, gas temperature, or moisture content of the gas in said individual gas storage caverns.

* * * * *